US010217576B2

(12) United States Patent
Zhang

(10) Patent No.: US 10,217,576 B2
(45) Date of Patent: Feb. 26, 2019

(54) BALANCING STRUCTURE FOR LONG KEY OF KEYBOARD

(71) Applicant: JIANGSU TRANSIMAGE TECHNOLOGY CO., LTD., Gaoyou, Jiangsu Province (CN)

(72) Inventor: Qing Zhang, Gaoyou (CN)

(73) Assignee: Jiangsu Transimage Technology Co., Ltd., Gaoyou (CN)

( * ) Notice: Subject to any disclaimer, the term of this patent is extended or adjusted under 35 U.S.C. 154(b) by 0 days.

(21) Appl. No.: 15/804,363

(22) Filed: Nov. 6, 2017

(65) Prior Publication Data

US 2018/0211801 A1 Jul. 26, 2018

(30) Foreign Application Priority Data

Jan. 24, 2017 (CN) ..... 2017 1 00535876

(51) Int. Cl.
*H01H 13/70* (2006.01)
*H01H 3/12* (2006.01)
*H01H 13/7065* (2006.01)

(52) U.S. Cl.
CPC ..... *H01H 13/70* (2013.01); *H01H 3/122* (2013.01); *H01H 13/7065* (2013.01); *H01H 2217/004* (2013.01); *H01H 2221/036* (2013.01); *H01H 2221/058* (2013.01); *H01H 2221/062* (2013.01)

(58) Field of Classification Search
CPC .... H01H 3/122; H01H 3/125; H01H 13/7065; H01H 13/705; H01H 13/14; H01H 2237/00
USPC ..... 200/5 A, 341–345, 314
See application file for complete search history.

(56) References Cited

U.S. PATENT DOCUMENTS 5,941,373 A * 8/1999 Cheng ..... H01H 3/122 200/344
6,100,482 A * 8/2000 Koma ..... H01H 3/122 200/344
6,239,391 B1 * 5/2001 Nishijima ..... H01H 13/7006 200/302.2
6,495,782 B1 * 12/2002 Huang ..... H01H 3/122 200/341
6,618,239 B2 * 9/2003 Takahashi ..... H01H 3/125 200/344
6,815,627 B2 * 11/2004 Chen ..... H01H 3/125 200/344
7,094,984 B2 * 8/2006 Yokoyama ..... B41J 5/12 200/344
7,199,320 B2 * 4/2007 Sato ..... H01H 3/122 200/341

(Continued)

*Primary Examiner* — Ahmed M Saeed
(74) *Attorney, Agent, or Firm* — Rankin, Hill & Clark LLP

(57) ABSTRACT

A balancing structure for a long key of a keyboard includes a balancing rod and a pair of clamping hooks arranged on a bottom plate of the keyboard. The balancing rod includes a cross rod matched with a keycap of the key and two sliding rods extending from two end parts of the cross rod and matched with the pair of clamping hooks respectively. During the keycap pressing or spring-back process, each of the two sliding rods slides on a clamping port edge on at least one side of the corresponding clamping hook along with the rotation of the cross rod, and the moving trajectory of the contact point of each sliding rod and the corresponding port edge is an arc in the sliding process.

4 Claims, 5 Drawing Sheets

(56) References Cited

U.S. PATENT DOCUMENTS

| | | | | |
|---|---|---|---|---|
| 7,265,310 | B1 * | 9/2007 | Wang | H01H 3/122<br>200/344 |
| 8,410,385 | B2 * | 4/2013 | Dai | H01H 23/02<br>200/296 |
| 2010/0025213 | A1 * | 2/2010 | Li | H01H 3/125<br>200/344 |

* cited by examiner

BALANCING STRUCTURE FOR LONG KEY OF KEYBOARD

TECHNICAL FIELD

The present invention relates to an improved structure for a special key of a keyboard, and more particularly, to a balancing structure for a long key of a keyboard.

BACKGROUND

The special keys of a keyboard are usually large. Excluding using a scissor structure independently, a balancing rod is also required to serve as a supporting point, so as to increase the using comfortableness of the keyboard. As illustrated in FIG. 1, in a traditional structure, a balancing rod 400 comprises a cross rod 410 and two sliding rods 420, the two sliding rods 420 are matched with a clamping hook 300 of a bottom plate 100, the clamping hook 300 of the bottom plate is in a rectangle shape, and there are gaps among the sliding rods 420 and the four sides of the clamping hook 300 when the two are matched for use. When the key is pressed, the cross rod 410 rotates, which drives the sliding rods 420 to swing in the clamping hook 300 of the bottom plate and directly collide the four sides of the rectangle shape. Because both the balancing rod 400 and the bottom plate 100 of the keyboard are made of metal, abnormal sounds can be produced during impact. At present, a common solution is to coat lubricating oil on the balancing rod 400, or put a layer of non-metal material on the bottom plate 100 usually, but none of these methods are stable, and the actual effect achieved is poor. On this base, the inventor develops the technology of the invention under the condition of not changing any material of the keyboard.

SUMMARY

Object of the Invention regarding the problem of abnormal sounds produced by impact of the balancing rod to the bottom plate in the existing special key of the keyboard, a balancing structure for a long key is provided to avoid impact of the balancing rod generated in the sliding process, so as to avoid abnormal sounds.

Technical Solution a balancing structure for a long key of a keyboard according to the present invention comprises a balancing rod and a pair of clamping hooks on a bottom plate of the keyboard, wherein the balancing rod comprises a cross rod matched with a keycap of the key and two sliding rods extending from two end parts of the cross rod and matched with the pair of clamping hooks respectively; and during the keycap pressing or spring-back process, each of the two sliding rods slides on a clamping port edge on at least one side of the corresponding clamping hook along with the rotation of the cross rod, and the moving trajectory of the contact point of each sliding rod and the corresponding port edge is an arc in the sliding process.

According to the balancing structure, the moving trajectory of the contact point of each sliding rod and the corresponding clamping port edge is an arc in the sliding process of each sliding rod, that is, the sliding rod moves along an arc path on the corresponding clamping port edge in the sliding process, buffer is formed in the motion process of the sliding rods, thus direct impact on the clamping hooks cannot be caused and abnormal sounds cannot be produced.

To be specific, the matching mode of the sliding rod and the clamping port edge may include two types.

According to the first mode, the sliding rod (3) slides on the clamping port edge on one side of the corresponding clamping hook, and in the sliding process, the sliding rod is at least contacted with two points of the clamping port edge on the side at the same time, and the sliding rod is seamlessly matched with the corresponding clamping port edge.

According to the second mode, the sliding rod slides at the two clamping port edges of the corresponding clamping hook at the same time, and in the sliding process, at least one point at the two clamping port edges is contacted with the sliding rod, and the sliding rod is seamlessly matched with the corresponding clamping port edge.

In the two modes above, the sliding rod is at least contacted with two points on the clamping port edge at the same time, the two points form a line, and the moving trajectory of the line is a curve. That is, the sliding rod moves along the arc in the slide process; moreover, the sliding rod is seamlessly matched with the corresponding clamping port edge, so that the sliding rod keeps in a bound state all the time during moving, and can slide closely to the clamping port edge. Therefore, the sliding rod can always move along the arc on the clamping port edge, thus impact on the clamping hooks cannot be caused and abnormal sounds can be avoided.

Preferably, the matched part between the clamping port edge and the corresponding sliding rod is an arc or a convex broken line, so that the sliding rod may be contacted with at least two points of the clamping port edge when the sliding rod is seamlessly matched with the clamping port edge.

The two clamping hooks and the two sliding rods respectively form two symmetrical matched parts, wherein the seamless matching between the sliding rod and the clamping port edge includes the two following situations.

When the protruding directions of the two matched parts are opposite, the distance between the matched parts with the sliding rods on the two clamping hooks is larger than or equal to the distance between the matched parts of the clamping hooks on the two sliding rods. At the moment, interference fit or zero-gap fit may be formed between the two sliding rods and the corresponding clamping hooks.

When the protruding directions of the two matched parts are opposite, the distance between the matched parts with the sliding rods on the two clamping hooks is smaller than or equal to the distance between the matched parts of the clamping hooks on the two sliding rods. At the moment, interference fit or zero-gap fit is also formed between the two sliding rods and the corresponding clamping hooks.

Beneficial effects: compared with the prior art, the present invention has the obvious advantages that: under the condition of not changing the material of any part of the keyboard, impact on the balancing rod cannot be caused during sliding through the way of changing the matching mode between the balancing rod and the bottom plate, so that abnormal sounds produced when using the long key of the keyboard can be avoided fundamentally.

DETAILED DESCRIPTIONS

The technical solution of the present invention will be further described hereinafter with reference to the drawings.

Figure 1:
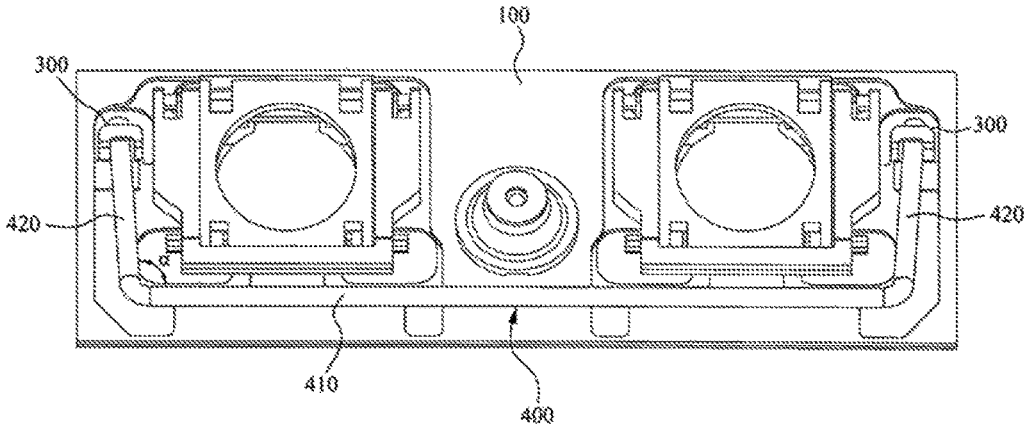
FIG. 1 is a schematic diagram illustrating a matching structure of a balancing rod and a bottom plate in a long key of a keyboard in the prior art.
Figure 2:
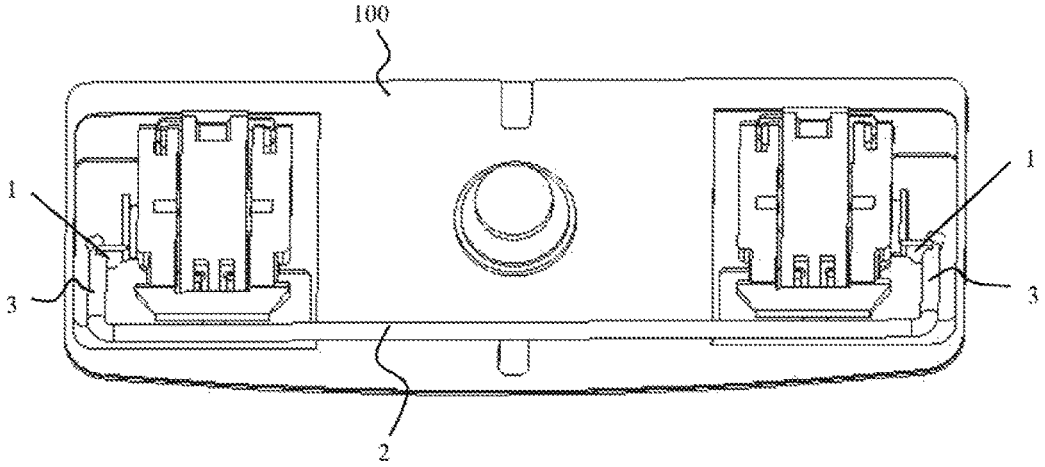
FIG. 2 is a schematic diagram illustrating a balancing structure for a long key of a keyboard according to the present application.

As illustrated in FIG. 2, a balancing structure for a long key of a keyboard comprises a balancing rod and a pair of clamping hooks 1 on a bottom plate 100 of the keyboard, wherein the balancing rod comprises a cross rod 2 and two sliding rods 3 extending from two end parts of the cross rod 2, and the two sliding rods 3 are symmetrically arranged. The cross rod 2 is used for being matched with a keycap of the key, the two sliding rods 3 are matched with the pair of clamping hooks 1 respectively. When any position on the keycap is pressed, the keycap drives the balancing rod to generate linkage to finish inputting.

The clamping hook 1 has a clamping hook groove which comprises a groove channel and clamping port edges 11 at two sides of the groove channel. The two sliding rods 3 are contacted and matched with the clamping port edges 11 of the corresponding clamping hooks 1; and during the keycap pressing or spring-back process, the cross rod 2 rotates to drive the two sliding rods 3 to slide on the clamping port edge 11 on one side of the corresponding clamping hook 1, and the moving trajectory of the contact point of each sliding rod 3 and the corresponding port edge 11 is an arc in the sliding process.

The matching mode of the sliding rod 3 and the clamping port edge 11 may include two types.

According to the first mode, the sliding rod 3 slides on the clamping port edge 11 on one side of the corresponding clamping hook 1, and in the sliding process, the sliding rod 3 is at least contacted with two points of the clamping port edge 11 at the side at the same time, and the sliding rod 3 is seamlessly matched with the corresponding clamping port edge 11, as illustrated in embodiments 1 to 4.

According to the second mode, the sliding rod 3 slides at the two clamping port edges of the corresponding clamping hook at the same time, and in the sliding process, at least one point at the two clamping port edges 11 is contacted with the sliding rod 3, and the sliding rod 3 is seamlessly matched with the corresponding clamping port edge 11, as illustrated in embodiment 5.

Embodiment 1

Figure 4A:
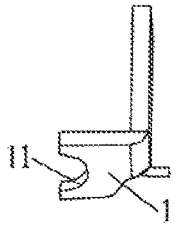
FIG. 4*a* is a schematic diagram illustrating a clamping hook at a left side in embodiment 1.
Figure 4B:
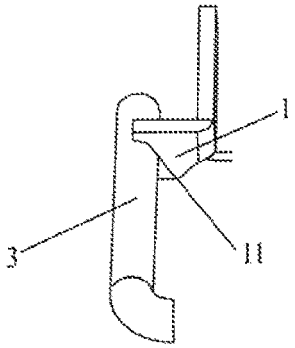
FIG. 4*b* is a schematic diagram illustrating a matching structure of the sliding rod and the clamping hook at the left side in embodiment 1.

As illustrated in FIG. 2 and FIGS. 4*a* to 4*b*, the two clamping hooks 1 are of an open style, the clamping port edge corresponding to the clamping hook at the left side is in an opposite C-shape, the clamping port edge corresponding to the clamping hook at the right side is in a C-shape, and the left and right sliding rods 3 are matched with the clamping port edges 11 at one side of the left and right clamping hooks 1 respectively.

Figure 3A:
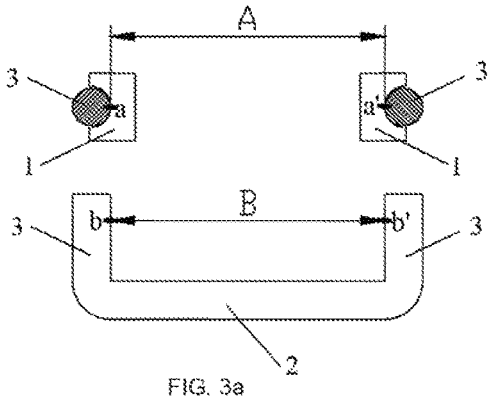
FIG. 3*a* is a first seamless matching mode between a sliding rod and a clamping port edge in the present application.

As illustrated in FIG. 3*a*, the distance between the matched parts a and a' with the sliding rod 3 on the two clamping hooks 1 is A, the distance between the matched parts b and b' with the clamping hook 1 on the two sliding rods 3 is B, and A is larger than or equal to B, so that the two clamping hooks 1 are seamlessly matched with the sliding rods 3. When A is larger than B, interference fit is formed between the two sliding rods 3 and the corresponding clamping hooks 1; and when A is equal to B, zero-gap fit is formed between the two sliding rods 3 and the corresponding clamping hooks 1.

Because the two clamping hooks 1 and the two sliding rods 3 are all symmetrically arranged with each other, the matching modes of the left and right sliding rods 3 with the corresponding clamping hooks 1 are the same when the sliding rods 3 are sliding. To facilitate understanding, the matching mode of the left sliding rod and the left clamping hook in the keycap pressing press is illustrated as an example.

Under an initial state, due to the seamless matching between the sliding rod 3 and the clamping hook 1, the arc surface of the sliding rod 3 clamps the C-shaped clamping port edge 11 on one side of the clamping hook 3 close to the cross rod 2 under the pressure of the clamping hook 1, and line contact is formed between the two, which comprises a plurality of contact points; when the keycap is pressed, the cross rod 2 of the balancing rod rotates, the sliding rod 3 is forced to slides on the clamping port edge 11 on the side, and meanwhile, the sliding rod 3 clamps the clamping port edge 11 to keep line contact with the clamping port edge 11; when the keycap springs back, since the sliding rod 3 has elasticity and tension, the sliding rod 3 continuously clamps the clamping port edge 11 during the spring-back motion, and keeps line contract with the clamping port edge 11; that is, the sliding rod 3 always keeps a bound state during sliding, and the C-shaped or opposite C-shaped clamping port edges provide an arc moving orbit for the sliding of the sliding rod 3, so that the moving trajectory of any point on the sliding rod 3 contacted with the clamping port edge 11 is an arc in the sliding process, and the sliding rod 3 moves along the arc on the clamping port edge 11, which has a certain buffer effect, thus impact on the clamping hooks 1 cannot be caused and abnormal sounds cannot be produced.

Figure 4C:
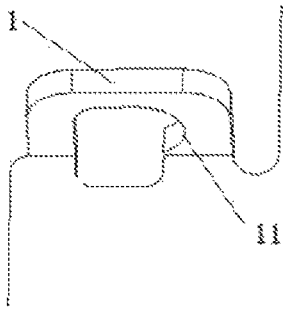
FIG. 4*c* is a schematic diagram illustrating a deformation structure of the clamping hook in embodiment 1.
Figure 4D:
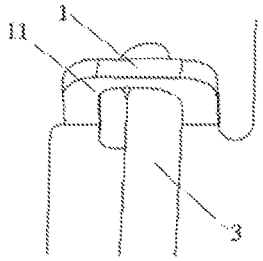
FIG. 4*d* is a schematic diagram illustrating a matching structure of the clamping hook and the sliding rod in FIG. 4*c;*

Excluding the C-shape, the clamping hook 1 in FIGS. 4*a* and 4*b* may further have multiple deformation structures. FIGS. 4*c* to 4*d* namely illustrate a deformation form of the clamping hook in the embodiment. In the Figs. the clamping port edge 11 is in an n-shape, and the matched part with the sliding rod 3 is an arc part on the clamping port edge 11; in addition, the clamping hook 1 in the embodiment may further have multiple deformations as long as the arc part which can be matched with the sliding rod 3 exists on the clamping port edge 11 of the clamping hook 1.

Embodiment 2

Figure 5A:
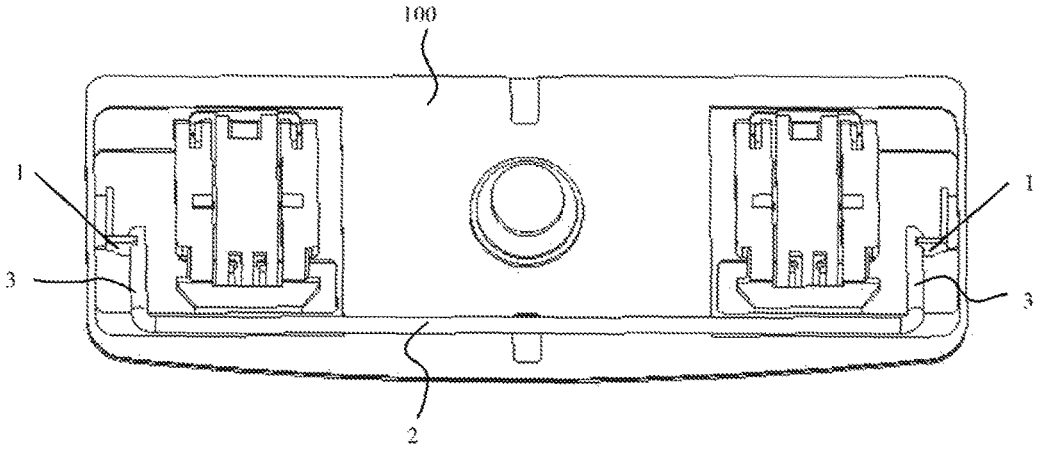
FIG. 5*a* is a schematic diagram illustrating a balancing structure for a long key of a keyboard in embodiment 2.
Figure 5B:
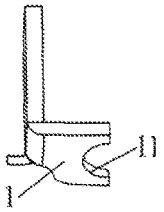
FIG. 5*b* is a schematic diagram illustrating a clamping hook at a left side in embodiment 2.
Figure 5C:
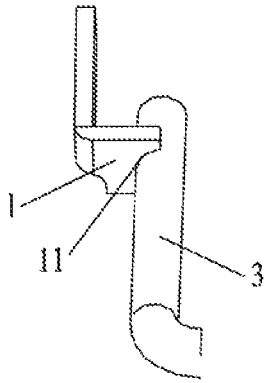
FIG. 5*c* is a schematic diagram illustrating a matching structure of a sliding rod and the clamping hook at the left side in embodiment 2.

As illustrated in FIGS. 5*a* to 5*b*, the shape of the clamping hook in the embodiment is the same as that in embodiment 1, but the seamless matching mode between the clamping hook 1 and the sliding rod 3 is not the same as that in embodiment 1. In the embodiment, the corresponding clamping port edge of the clamping hook at the left side is in a C-shape, the corresponding clamping port edge of the left clamping hook is in an opposite C-shape. FIGS. 5*a* to 5*b* illustrate the matching mode between the sliding rod at the left side and the clamping hook at the left side.

Figure 3B:
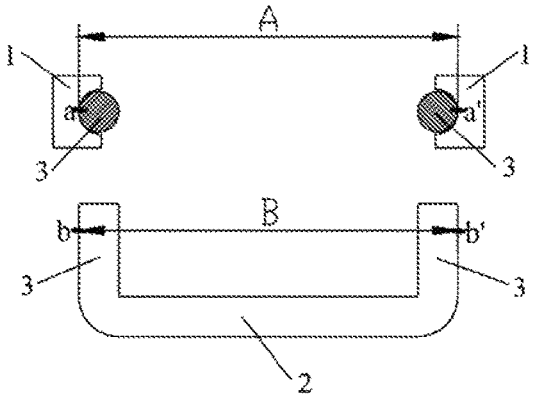
FIG. 3*b* is a second seamless matching mode between the sliding rod and the clamping port edge in the present application.

As illustrated in FIG. 3*b*, the distance between the matched parts a and a' with the sliding rod 3 on the two clamping hooks 1 is A, the distance between the matched parts b and b' with the clamping hook 1 on the two sliding rods 3 is B, and A is smaller than or equal to B, so that the two clamping hooks 1 are seamlessly matched with the sliding rod 3; when A is smaller than B, interference fit is formed between the two sliding rods 3 and the corresponding clamping hook 1; and when A is equal to B, zero-gap fit is formed between the two sliding rods 3 and the corresponding clamping hook 1.

Similar to the principles in embodiment 1, when the keycap moves up and down, the sliding rod 3 always keeps a bound state, and always moves along the arc path on the clamping port edge 11, which has a certain buffer effect, thus impact on the clamping hooks 1 cannot be caused and abnormal sounds cannot be produced.

In a similar way, the shape of the clamping hook 1 in FIGS. 5*a* to 5*b* may also have multiple deformation forms as long as the arc part which can be matched with the sliding rod 3 exists on the clamping port edge 11 of the clamping hook 1.

Embodiment 3

Figure 6A:
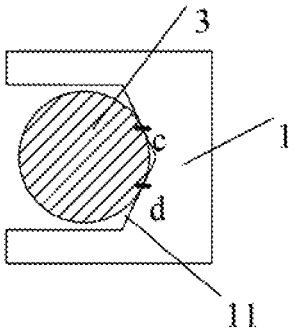
FIG. 6*a* is a schematic diagram illustrating a sectional structure of the matched part of a sliding rod and a clamping hook at a left side in embodiment 3.

As illustrated in FIG. 6*a*, the two clamping hooks 1 are of an open style, the clamping port edge 11 is of a convex broken line shape, the protruding directions of the clamping port edges of the left and right clamping hooks are opposite, and the two sliding rods 3 are seamlessly matched with the corresponding clamping hook 1, so that the sliding rod 3 always keeps a bound state under the pressure of the clamping hook 1 or the elastic tension effect of the sliding rod, and the seamless matching mode is the same as that in embodiment 1.

The two sliding rods 3 slide on the clamping port edges 11 on one side of the two clamping hooks 1 respectively. Take the matched part between the sliding rod at the left side and the clamping hook at the left side for example: under the initial state, the sliding rod 3 and the clamping port edge 11 form two contact points c and d, when the keycap is pressed, the sliding rod 3 slides and the two contact points c and d move along with the sliding rod. In the sliding process of the sliding rod, the two contact points c and d move in the convex broken line area of the clamping port edge 11, and the moving trajectory of the contact points is an arc. That is, the sliding rod 3 moves along the arc on the clamping port edge 11, which has a certain buffer effect, thus impact on the clamping hooks 1 cannot be caused and abnormal sounds cannot be produced.

Figure 6B:
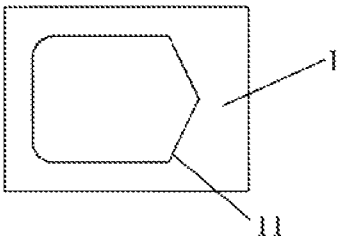
FIG. 6*b* is a front view of a deformation structure of the clamping hook in embodiment 3.

Similarly, the shape of the clamping hook 1 in FIG. 6*a* may also have multiple deformations as long as convex broken line part matched with the sliding rod 3 exists on the clamping port edge 11, which is as illustrated in FIG. 6*b*.

Embodiment 4

Figure 7A:
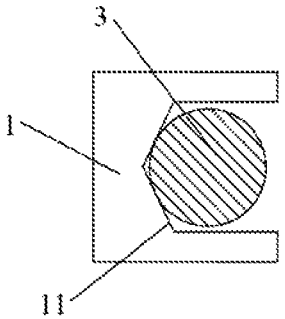
FIG. 7*a* is a schematic diagram illustrating a sectional structure of the matched part of a sliding rod and a clamping hook at a left side in embodiment 4.

As illustrated in FIG. 7*a*, the shapes of the two clamping hooks 1 are similar to that in embodiment 3, both of which are convex broken line, while the difference lies in that the protruding directions of the clamping port edges of the left and right clamping hooks are opposite, and the seamless matching mode thereof is the same as that in embodiment 2.

Figure 7B:
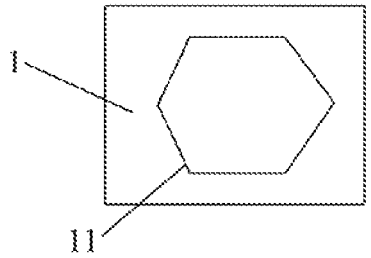
FIG. 7*b* is a front view of a deformation structure of the clamping hook in embodiment 4.

FIG. 7*b* illustrates a deformation structure of the clamping hook in the embodiment, the clamping port edge of the clamping hook is a hexagon, and both the convex broken line parts at the left and right sides of the clamping port edge may be matched with the sliding rod 3.

Embodiment 5

Figure 8A:
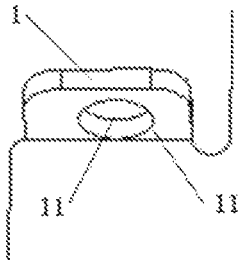
FIG. 8*a* is a schematic diagram illustrating a clamping hook at a left side in embodiment 5.
Figure 8B:
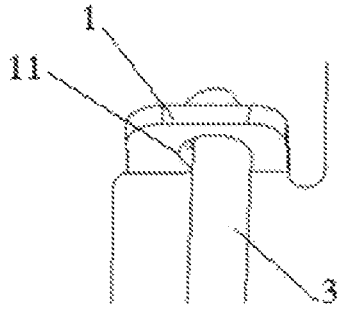
FIG. 8*b* is a schematic diagram illustrating a matching structure of a sliding rod and the clamping hook at the left side in embodiment 5.

As illustrated in FIGS. 8*a* to 8*b*, both the clamping port edges 11 of the two clamping hooks 11 are closed circles, and the sliding rods 3 are contacted with one point on the clamping port edges 11 at the two sides of the corresponding clamping hook 1 respectively at the same time. FIG. 8*b* is a diagram illustrating a matching mode of the clamping hook at the left side and the sliding rod, and the seamless matching mode of the clamping hook 1 and the sliding rod 3 in the embodiment is the same as that in embodiment 1.

When the keycap moves up and down, the sliding rod 3 slides on the clamping port edges 11 at the two sides; in the sliding process, the sliding rod 3 always has a contract point with the clamping port edges 11 at the two sides respectively, the sliding rod 3 always keeps a bound state, and the circular clamping port edges at the two sides provide an arc moving orbit for the sliding rod 3 to slide. That is, the moving trajectory of the contract point with the clamping port edges 11 on the sliding rod 3 is an arc, and the sliding rod 3 moves along the arc on the clamping port edges 11, which has a certain buffer effect, thus impact on the clamping hooks 1 cannot be caused and abnormal sounds cannot be produced.

The invention claimed is:

1. A balancing structure for a long key of a keyboard, comprising a balancing rod and a pair of clamping hooks on a bottom plate of the keyboard;

wherein the balancing rod comprises a cross rod matched with a keycap of the key and two sliding rods extending from two end parts of the cross rod and matched with the pair of clamping hooks respectively, and during the keycap pressing or spring-back process, each of the two sliding rods slides on a clamping port edge on at least one side of a corresponding clamping hook along with a rotation of the cross rod, and a moving trajectory of a contact point of each sliding rod and a corresponding clamping port edge is an arc in a sliding process;

wherein each sliding rod slides on the clamping port edge on one side of the corresponding clamping hook, and in the sliding process, each sliding rod is at least contacted with two points of the clamping port edge on the one side at the same time by a matching part between the clamping hook and the respective sliding rod, and the respective sliding rod is seamlessly matched with the corresponding clamping port edge by the matching part;

wherein the matching part between the clamping port edge and the corresponding sliding rod is an arc or a convex broken line; and wherein the two clamping hooks and the two sliding rods respectively form two symmetrical matched parts, a protruding direction of the two matched parts are opposite, and a distance between the matched parts with the sliding rods on the two clamping hooks is larger than or equal to the distance between the matched parts with the clamping hooks on the two sliding rods.

2. The balancing structure for a long key of a keyboard according to claim 1, wherein each sliding rod slides on the clamping port edge at two sides of the corresponding clamping hook, and in the sliding process, at least one point on the clamping port edge at the two sides is respectively contacted with the respective sliding rod by a matching part between the clamping hook and the respective sliding rod, and the respective sliding rod is seamlessly matched with the corresponding clamping port edge by the matching part.

3. A balancing structure for a long key of a keyboard, comprising a balancing rod and a pair of clamping hooks on a bottom plate of the keyboard;

wherein the balancing rod comprises a cross rod matched with a keycap of the key and two sliding rods extending from two end parts of the cross rod and matched with the pair of clamping hooks respectively, and during the keycap pressing or spring-back process, each of the two sliding rods slides on a clamping port edge on at least one side of a corresponding clamping hook along with a rotation of the cross rod, and a moving trajectory of a contact point of each sliding rod and a corresponding clamping port edge is an arc in a sliding process;

wherein each sliding rod slides on the clamping port edge on one side of the corresponding clamping hook, and in the sliding process, each sliding rod is at least contacted with two points of the clamping port edge on the one side at the same time by a matching part between the clamping hook and the respective sliding rod, and the respective sliding rod is seamlessly matched with the corresponding clamping port edge by the matching part;

wherein the matching part between the clamping port edge and the corresponding sliding rod is an arc or a convex broken line;

wherein the two clamping hooks and the two sliding rods respectively form two symmetrical matched parts, a protruding direction of the two matched parts are opposite, and a distance between the matched parts with the sliding rods on the two clamping hooks is smaller than or equal to the distance between the matched parts with the clamping hooks on the two sliding rods.

4. The balancing structure for a long key of a keyboard according to claim 3, wherein each sliding rod slides on the clamping port edge at two sides of the corresponding clamping hook, and in the sliding process, at least one point on the clamping port edge at the two sides is respectively contacted with the respective sliding rod by a matching part between the clamping hook and the respective sliding rod, and the respective sliding rod is seamlessly matched with the corresponding clamping port edge by the matching part.

* * * * *